US006742260B1

(12) United States Patent
Hsu

(10) Patent No.: US 6,742,260 B1
(45) Date of Patent: Jun. 1, 2004

(54) STRUCTURE ART DESIGN KNIFE

(76) Inventor: Cheng-Hui Hsu, No.126,Pao Chung Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/373,032

(22) Filed: Feb. 26, 2003

(51) Int. Cl.[7] ..... B26B 1/08
(52) U.S. Cl. ..... 30/162; 30/125; 30/340
(58) Field of Search ..... 30/162, 125, 335, 30/340

(56) References Cited

U.S. PATENT DOCUMENTS 6,192,589 B1 * 2/2001 Martone et al. ..... 30/125
6,276,014 B1 * 8/2001 Lee ..... 7/158
6,374,496 B1 * 4/2002 Hsu ..... 30/162
6,374,497 B1 * 4/2002 Sun ..... 30/162
6,502,311 B1 * 1/2003 Khachatoorian et al. ..... 30/162
6,513,246 B2 * 2/2003 Ping ..... 30/125
6,574,872 B2 * 6/2003 Roberts et al. ..... 30/330

* cited by examiner

*Primary Examiner*—Douglas D. Watts
(74) *Attorney, Agent, or Firm*—Rosenberg, Klein & Lee

(57) ABSTRACT

An improved structure art design knife that provides for stabler and safer manual grasping, the arrangement of which includes a front cover, a back cover, a hatch, a flat spring, and a blade holder mechanism. In addition to convenient blade replacement, the art design knife of the present invention contains a plurality of spare blades, thereby enhancing the utility of such structures and, furthermore, increasing practical value from a production standpoint.

1 Claim, 10 Drawing Sheets

STRUCTURE ART DESIGN KNIFE

BACKGROUND OF THE INVENTION

1) Field of the Invention

The invention herein relates to utility cutters and knives, specifically an improved structure art design knife that provides for stabler and safer manual grasping, the arrangement of which includes a front cover, a back cover, a hatch, a flat spring, and a blade holder mechanism. In addition to convenient blade replacement, the art design knife of the present invention contains a plurality of spare blades, thereby enhancing functionality and, furthermore, increasing practical value from a production standpoint.

2) Description of the Prior Art

In a conventional art design knife, frictional wear between the tensile pawl and the wave-profiled rack of the blade extension/retraction, mechanism often reduces overall structural rigidity such that blades cannot be consistently fixed into position, resulting in a greater risk of user injury. Moreover, the spare blades of a conventional art knife are typically situated external to the body of the knife. As such, considerable time is wasted searching for extra blades whenever a blade has to be replaced. Given the existent drawbacks of the conventional product and the need to overcome them, the applicant of the invention herein innovated an original solution and conducted extensive research based on design and other experience gained while engaged in the related industrial fields that culminated in the successful development of the improved structure art design knife of the invention herein.

SUMMARY OF THE INVENTION

The objective of the invention herein is to provide an improved structure art design knife in which the blade holder mechanism and the rack of the front cover and the back cover are of a balanced and stable arrangement to achieve blade positioning more effectively and safely and, furthermore, the present invention accommodates the internal storage of a plurality of spare blades, thereby integrating an extra blade supply within the body of the art design knife itself to further enhance blade replacement convenience and efficiency.

To enable the examination committee a further understanding of the means whereby the said objective is accomplished as well as the advantages, other objectives, and operation of the most preferred embodiment of the present invention, the brief description of the drawings below are followed by the detailed description of the invention herein.

DETAILED DESCRIPTION OF THE INVENTION

Figure 1:
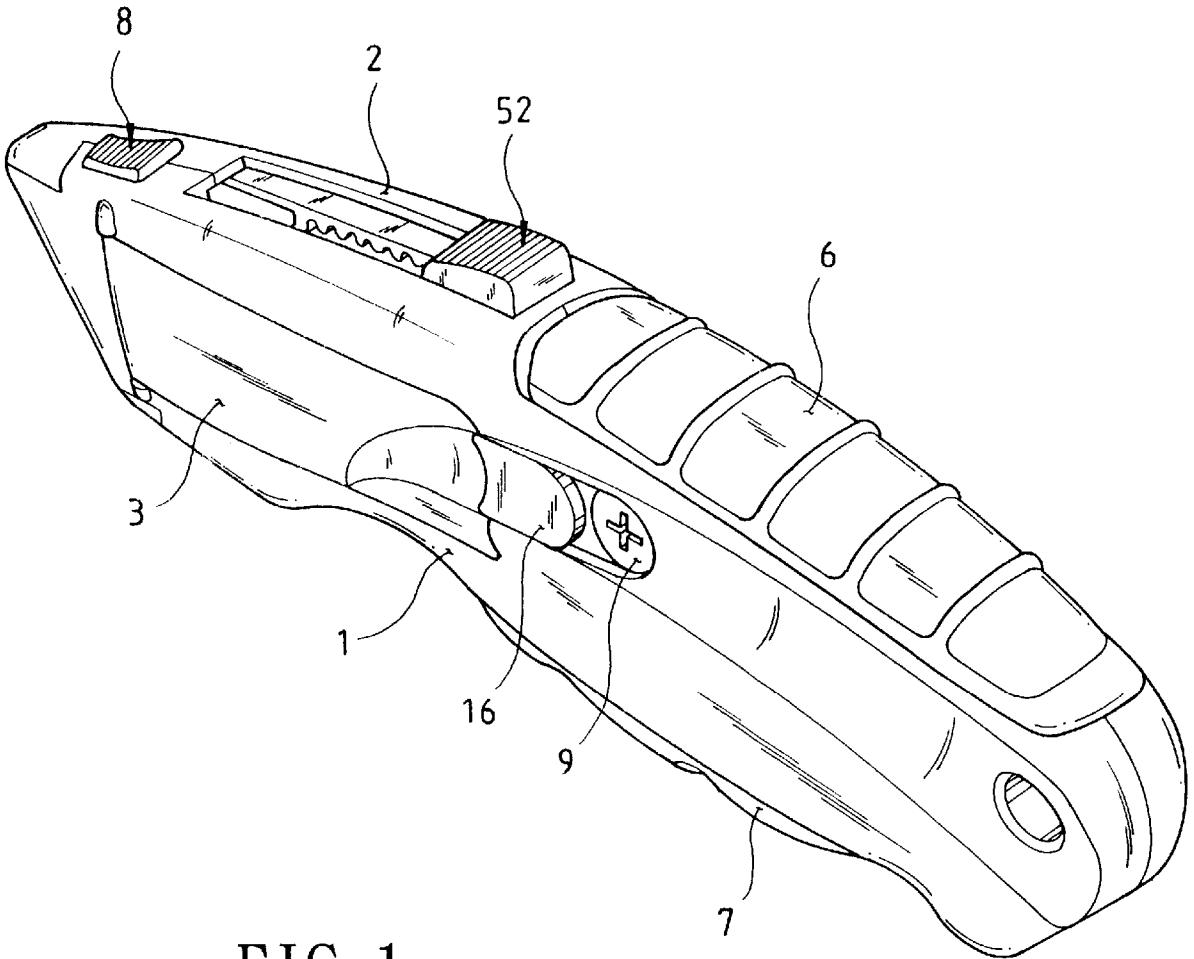
FIG. 1 is an isometric drawing of the invention herein.
Figure 2:
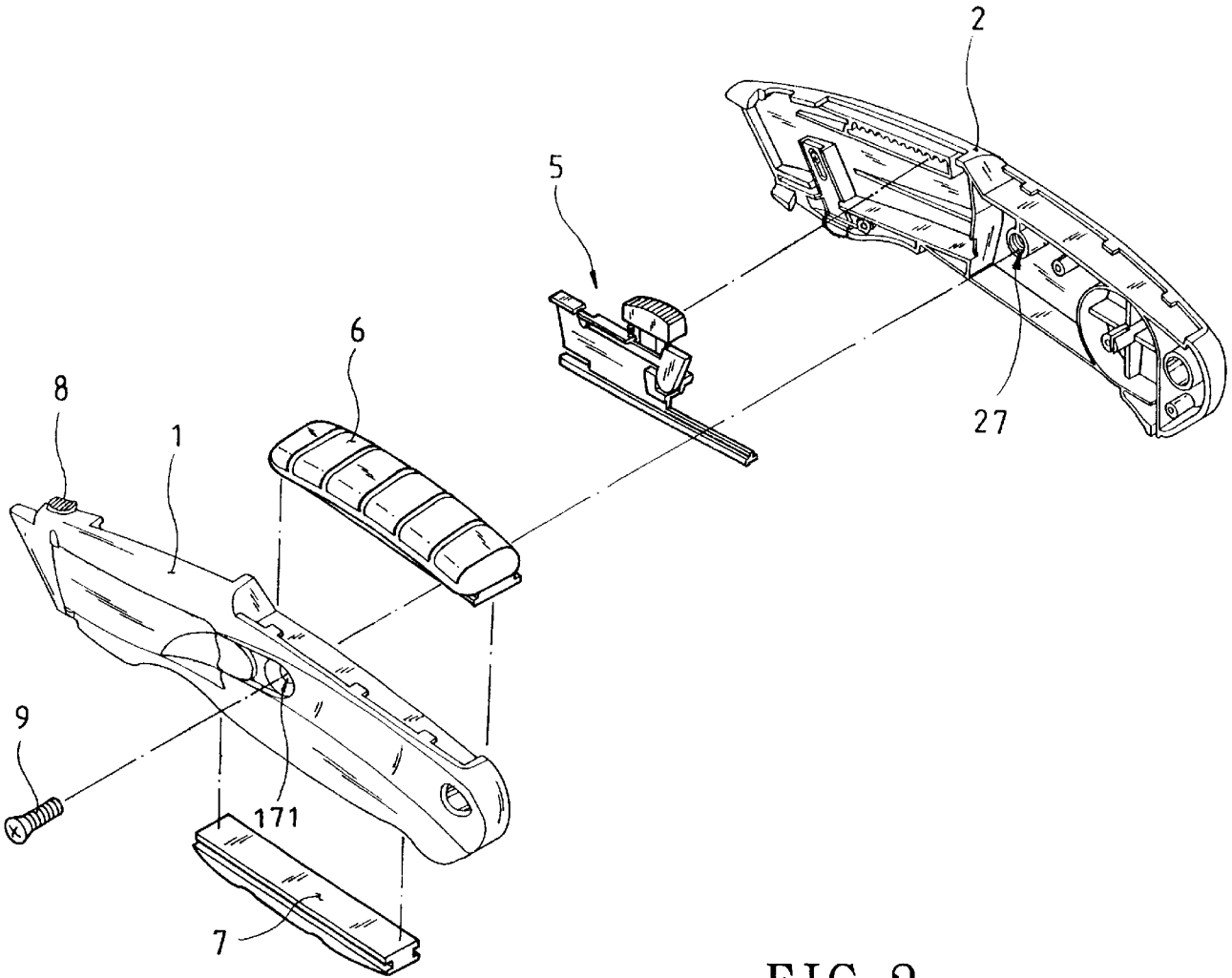
FIG. 2 is an exploded drawing of the invention herein.
Figure 3:
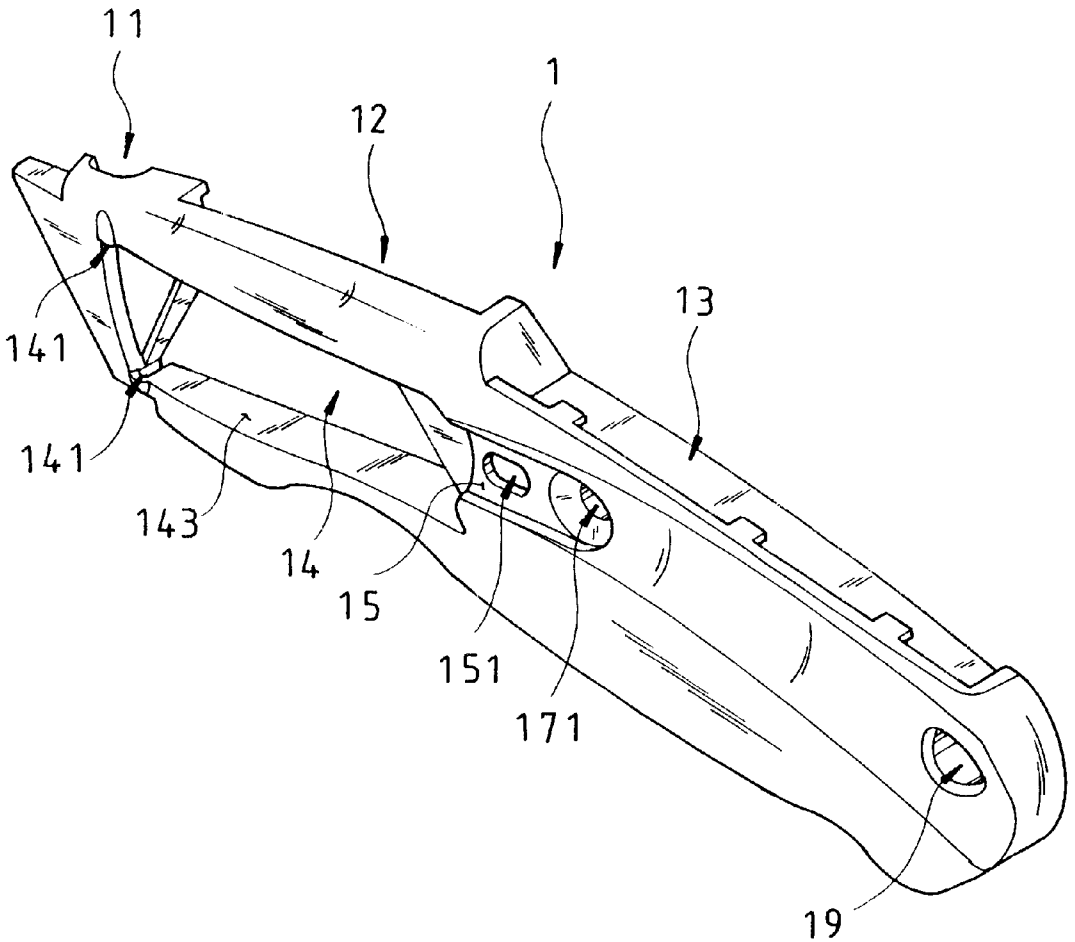
FIG. 3 is an isometric drawing of the front cover 1 of the invention herein.
Figure 4:
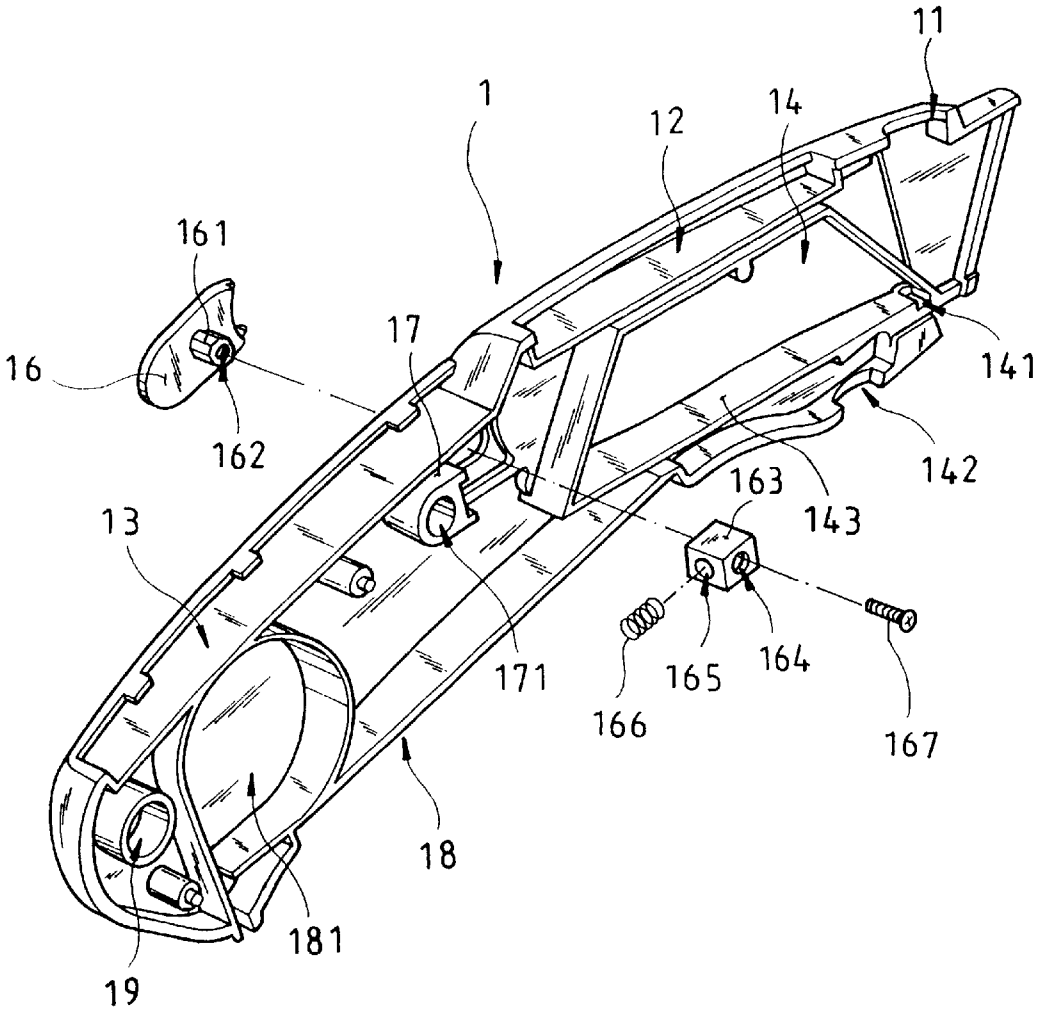
FIG. 4 is an isometric drawing of the front cover 1 of the invention herein.

Referring to FIG. 1 and FIG. 2, the improved structure art design knife of the invention herein is comprised of a front cover 1, a back cover 2, a hatch 3, a hatch lock button 16, a blade holder mechanism 5, a flat spring 4, a blade ejection button 25, a blade 56, a push button 52, a cushioning button 8, an upper grip pad 6, and a lower grip pad 7, wherein;

Referring to FIG. 3 and FIG. 4, the said front cover 1 is a shell plate of one-piece construction having a semicircular opening 11 in the top edge of its anterior section, a semicircular opening 142 in the bottom edge of the anterior section, and a slide slot 12 along the inside of the top edge; the said front cover 1 also has an elongated recess 13 along the top edge of its posterior section and, furthermore, an elongated opening 18 disposed along the bottom portion of the posterior section and a round tape rule enclosure 181 formed inside the posterior section; additionally, a compartment 14 is formed inside the anterior section of the said front cover 1, the said compartment 14 having an axial hole 141 at the both upper and lower corners of its forward edge, with the said compartment 14 recessively defined by a trapezoidal frame 143; the said front cover 1 has an oval backing plate situated at its middle section, with the said backing plate 15 having an elongated hole 151 at the center and, furthermore, the said backing plate also has a standoff block 17 at the inner side of its rear edge and a fastener hole 171 is formed through the center of the said standoff block 17; and a collar hole 19 is disposed through the posterior extremity of the said front cover 1. The hatch lock button 16 is oval in shape and has a check plate at one extremity of its inner side; furthermore, the said hatch lock button 16 has a standoff block 161 formed at the center of its inner side and a threaded hole 162 is tapped in the center of the said standoff block 161; the said locating block 163 is rectangular in shape and has a fastener hole 164 through one side and, furthermore, a blind hole 165 in the other side, with a coil spring 166 inserted into the said blind hole 165; the standoff block 161 of the said hatch lock button 16 is inserted into the elongated hole 151 at the center of the backing plate 15 of the front cover 1, a screw 167 is then inserted into the fastener hole 164 of the locating block 163 and tightened into the threaded hole 162 of the standoff block 161, enabling the assembly of the coil spring 166 and the locating block 163 such that the hatch lock button 16 is capable of being toggled back and forth on the backing plate 15 of the front cover 1.

Figure 5:
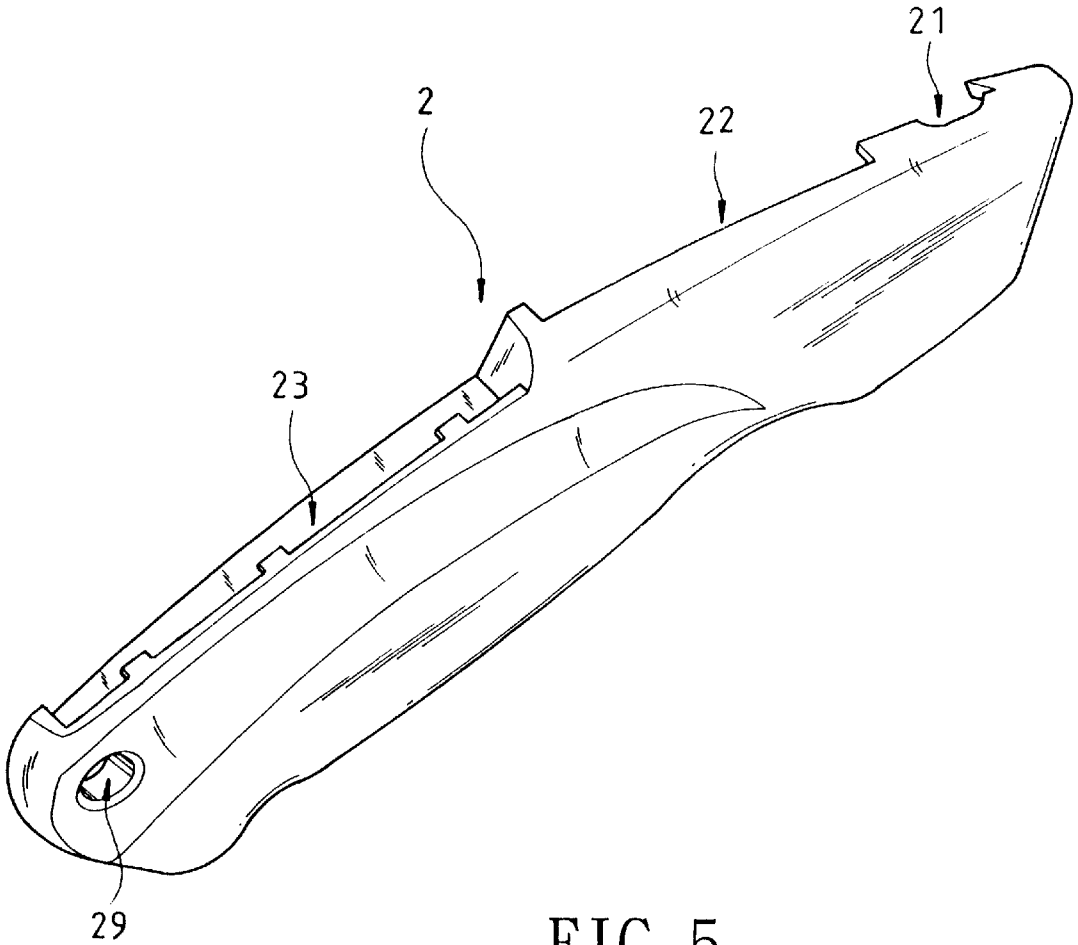
FIG. 5 is an isometric drawing of the back cover 2 of the invention herein.
Figure 6:
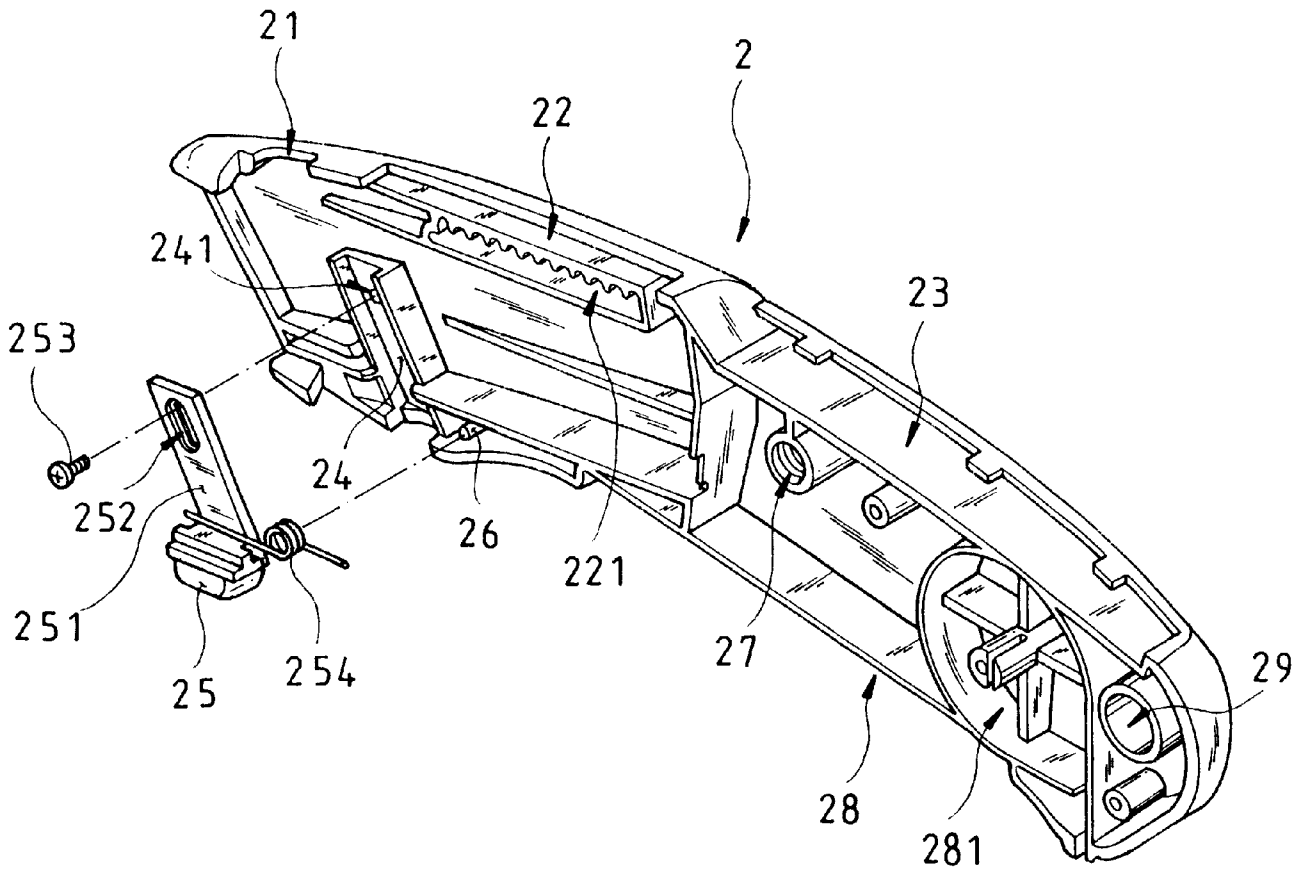
FIG. 6 is an isometric drawing of the back cover 2 of the invention herein.

Referring to FIG. 5 and FIG. 6, the said back cover 2 is a shell plate of one-piece construction having a semicircular opening 21 in the top edge of its anterior section and a slide slot 22 along the inside of the middle section top edge, with a wave-profiled rack 221 arrayed along the bottom edge of the said slide slot 21; the said rear cover 2 also has an elongated recess 23 along the top edge of its posterior section and, furthermore, an elongated opening 28 is disposed along the bottom portion of the posterior section and a round tape rule enclosure 281 is formed inside the posterior section; additionally, a vertically oriented slide channel 24 is formed inside the anterior section of the said back cover 2 and a threaded hole 241 is tapped at the top edge of the said slide channel 24; a slide plate 251 extends upward from the said blade ejection button 25, the said slide plate 251 having an elongated hole 252 through its top edge such that the said elongated hole 252 allows the insertion of a screw 253 which is fastened into the threaded hole 241 at the slide channel 24 of the back cover 2; the said back cover 2 has a shaft 26 integrated inside the bottom edge of its anterior section and a coil spring 254 is sleeved over the said shaft 26, with the extended portion of the said coil spring 254 postured horizontally against the bottom edge at the inner side of the blade ejection button 25 such that the blade ejection button 25 is constrained within the slide channel 24 of the back cover 2, but capable of shifting upward and downward; the said back cover 2 has a threaded mounting hole 27 at the center of its posterior section and, furthermore, a collar hole 29 is disposed through the posterior extremity of the back cover 2.

Figure 7:
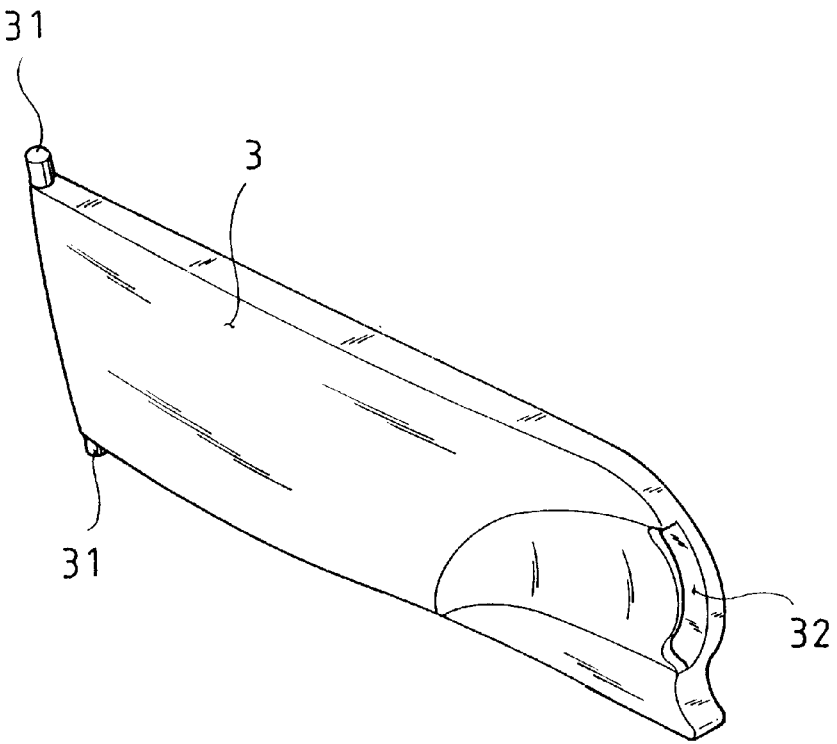
FIG. 7 is an isometric drawing of the hatch 3 of the invention herein.
Figure 8:
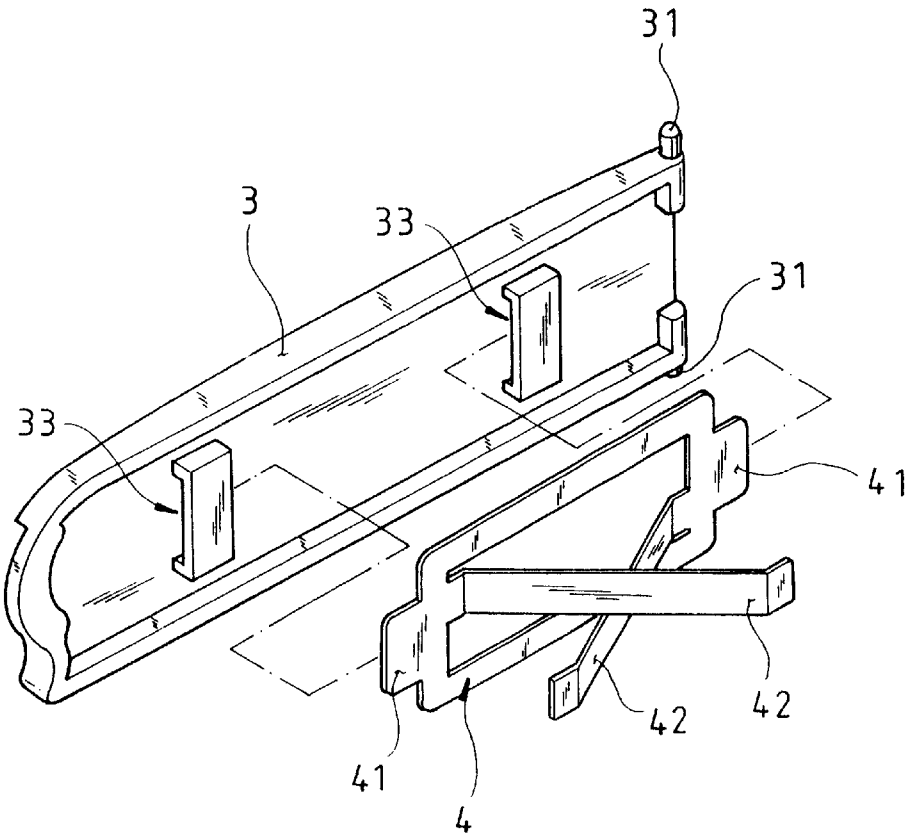
FIG. 8 is an isometric drawing of the hatch 3 of the invention herein.

Referring to FIG. 7 and FIG. 8, the said hatch 3 is shaped such that it is congruous with the said compartment 14 of the front cover 1; the said hatch 3 has a hinge pin 31 formed at each of the upper and lower corners of its anterior side, with the said hatch 3 also having an arcuate catch indentation 32 along the outer edge of the posterior side; additionally, a spring attachment slot 33 is formed at both the anterior and the posterior inner sides of the said hatch 3; the said flat spring 4 is a one-piece component with a mounting tab 41 at each of its two ends that is punched fabricated from sheet metal; two overlapping tensile elements 42 crisscross inward on the said flat spring 4; and the mounting tabs 41 of the said flat spring 4 are inserted into the spring attachment slots 33 along the inner side of the hatch 3.

Figure 9:
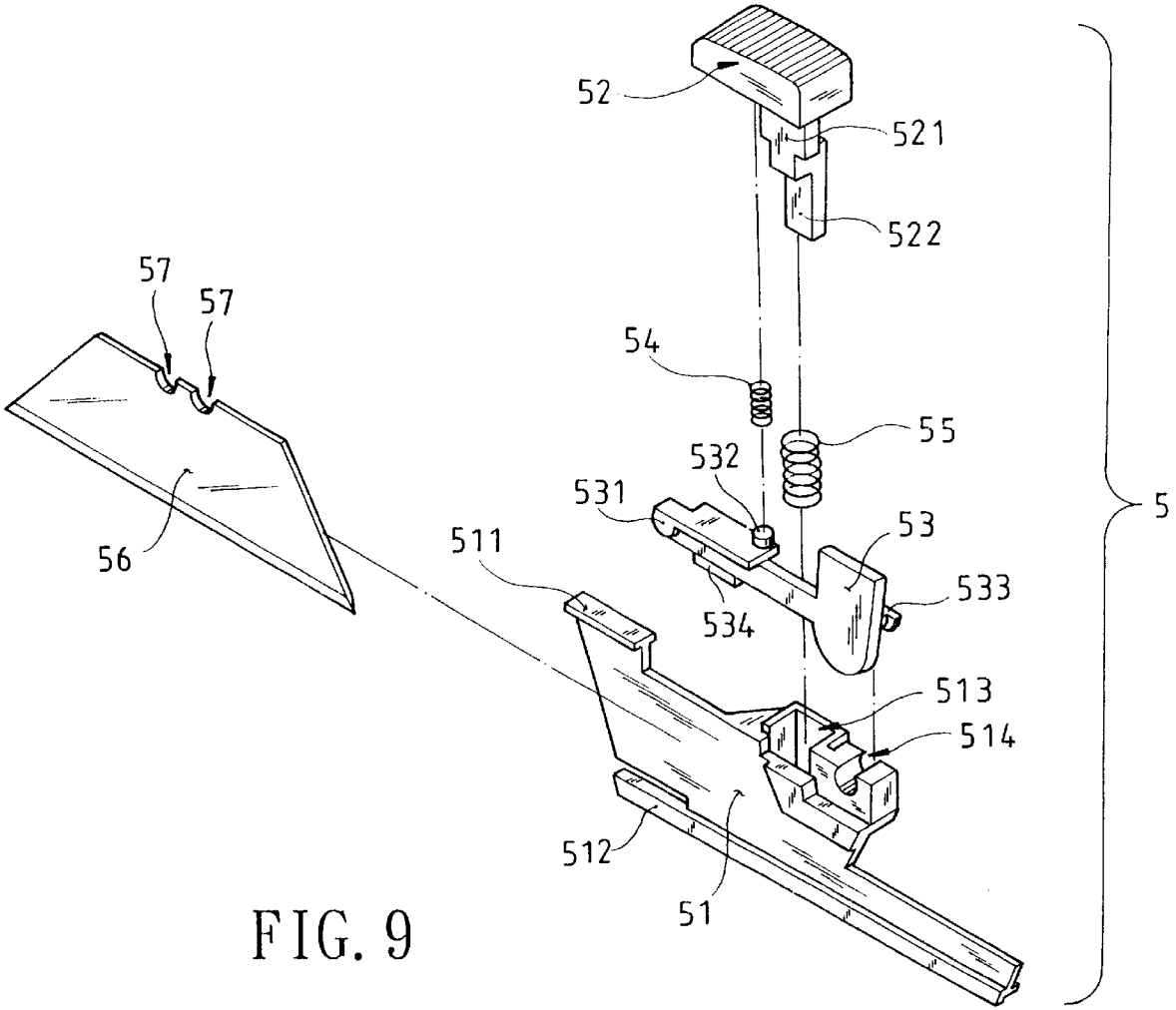
FIG. 9 is an exploded drawing of the blade holder mechanism 5 of the invention herein.
Figure 11:
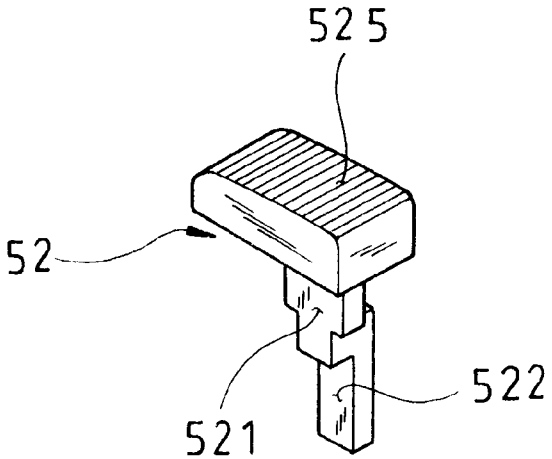
FIG. 11 is an isometric drawing of the push button 52 of the invention herein.
Figure 10:
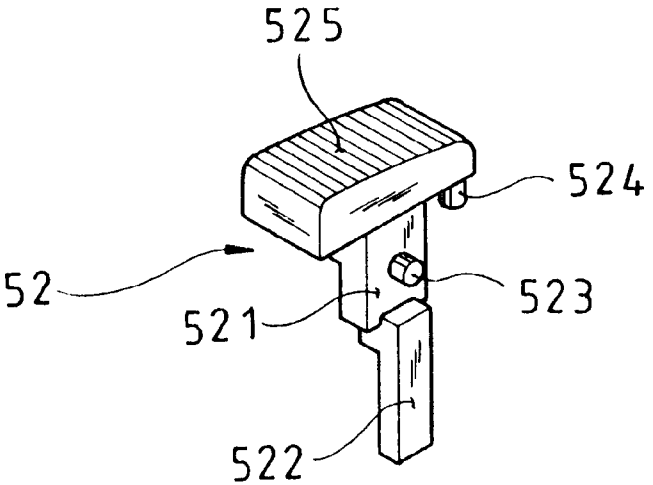
FIG. 10 is an isometric drawing of the push button 52 of the invention herein.

Referring to FIG. 9, FIG. 10, and FIG. 11, the said blade holder mechanism consists of a blade carrier 51, a push button 52, and a blade arresting component 53, wherein:

The push button 52 has a vertical support member 522 at the lower extent of its body 521; a cylindrical post 523 is formed in the center at one side of the body 521 and, furthermore, another cylindrical post 524 is formed on the push button 52 at the lower extent of its anterior edge; and the upper extent of the said push button 52 is surfaced with a pliant lining 525.

The blade arresting component 53 has a semicircular pawl 531 at the bottom edge of its anterior extremity, a cylindrical post 532 is disposed at the center of the upper edge of the said blade arresting component 53 and, furthermore, a support pin 533 emerges from one side at the posterior extremity of the blade arresting component 53 and the said blade arresting component 53 has a rectangular block 534 formed on the lower edge of its anterior section.

The blade carrier 51 has a T-shaped insertable element 511 formed along the upper edge of its anterior extremity and a skid element 512 along its lower edge; the said blade carrier 51 has a rectangular recess 513 in the center and, furthermore, a semicircular support pin notch 514 is formed in the upper edge at the posterior extremity of the said blade carrier 51.

The support pin 533 emerging from one side at the posterior extremity of the blade holder mechanism 5 blade arresting component 53 is fitted into the semicircular support pin notch 514 in the upper edge at the posterior extremity of the said blade carrier 51 a coil spring 54 is sleeved between the post 524 of the push button 52 and the post 532 disposed at the center of the blade arresting component 53; furthermore, the vertical support member 522 at the lower extent of the said push button 52 is placed through another coil spring 55 and then inserted into the rectangular recess 513 of the blade carrier 51; and the pawl 531 at the bottom edge along the anterior extremity of the blade arresting mechanism 53 engages the semicircular notch in the top edge of the blade 56, thereby securing the blade 56 in the blade holder mechanism 5.

The post 523 at one side of the blade holder mechanism 5 push button 52 of the invention herein is insertionally postured within the wave-profiled rack 221 beneath the upper edge along the anterior section of the back cover 2; the said cushioning button 8 is placed into the semicircular opening 11 in the top edge along the anterior section of the front cover 1; the said upper grip pad 6 is unitarily fabricated out of a soft plastic material and embedded in a long recess 13 molded in the top edge along the posterior section of the front cover 1; the said lower grip pad 7 is also unitarily fabricated of a soft plastic material but embedded in a long recess 18 molded in the bottom portion along the posterior section of the front cover 1; furthermore, the two hinge pins 31 of the said hatch 3 are coupled into the axial holes 141 of the front cover 3, enabling the closing of the hatch 3 over the compartment 14 of the front cover 1, with the hatch lock button 16 latching the hatch 3 against the front cover 1; and the front cover 1 and the rear cover 2 are connected together by inserting a screw 9 through the fastener hole 171 of the front cover 1 and then tightening it into the threaded mounting hole 27 of the back cover 2, thereby completing the assembly of the art design knife structure.

The post 523 of the push button 52 of the invention herein is positioned in the wave-profiled rack 221; when the push button 52 is depressed, the post 523 is disengaged from the wave-profiled rack 221 and the push button 52 is impelled outward such that the push button 52 causes the blade carrier 51, the blade arresting mechanism 53, and the blade 56 to slide outward; when the blade 56 slides to the appropriate position, the push button 52 is released and the coil springs 54 and 55 of the said push button 52 elastically rebound upward and position the said post 523 back into the wave-profiled rack 221, thereby achieving a safe and stable blade forwarding operation; to withdraw the blade 56, the same procedure is conducted in reverse by operating the push button 52 in the opposite direction.

To effect blade replacement, the blade ejection button 25 is pressed upward when the blade 56 is pushed beyond the anterior extremity of the art design knife, the top edge of the slide plate 251 of the said blade ejection button 25 lifts the rectangular block 534 at the lower edge along the anterior extremity of the blade arresting component 53, with the support pin 533 of the said blade arresting component serving as the pivoting axis, causing the pawl 531 at the anterior extremity of the blade arresting mechanism 53 to ascend and disengage from the notch 57 of the blade 56, thereby allowing the removal of the blade 56; the trapezoidal frame 143 in the said front cover 1 contains a plurality of preloaded, stacked blades 56 with the flat spring 4 at the inner side of the hatch 3 tensioned inward against the blades 56 such that the blades 56 are pushed to the very bottom level of the trapezoidal frame 143 and as the said blade arresting mechanism 53 returns, the pawl 531 of the blade arresting mechanism 53 once again engages the notch 57 in the upper edge of the blade 56, thereby completing the replacement of a blade.

In summation of the foregoing section, since the invention herein is capable of achieving the claimed utilization objectives and, furthermore, the disclosed structure possesses exceptional practical value and functionality, the present invention is submitted to the examination committee for review and the granting of the commensurate patent rights.

What is claimed is:

1. An improved structure art design knife comprised of a front cover, a back cover, a hatch, a hatch lock button, a blade holder mechanism, a flat spring, a blade ejection button, a blade, a push button, a cushioning button, an upper grip pad, and a lower grip pad, wherein:

the said front cover is a shell plate of one-piece construction having a semicircular opening in the top edge of its anterior section, a semicircular opening in the bottom edge of the anterior section, and a slide slot along the inside of the top edge; the said front cover also has an elongated recess along the top edge of its posterior section and, furthermore, an elongated opening disposed along the bottom portion of the posterior section and a round tape rule enclosure formed inside the posterior section; additionally, a compartment is formed inside the anterior section of the said front cover, the said compartment having an axial hole at the both upper and lower corners of its forward edge, with the said compartment recessively defined by a trapezoidal frame; the said front cover has an oval backing plate situated at its middle section, with the said backing plate having an elongated hole at the center and, furthermore, the said backing plate also has a standoff block at the inner side of its rear edge and a fastener hole is formed through the center of the said standoff block; and a collar hole is disposed through the posterior extremity of the said front cover; the said hatch lock button is oval in shape and has a check plate at one extremity of its inner side; furthermore, the said hatch lock button has a standoff block formed at the center of its inner side and a threaded hole is tapped in the center of the said standoff block; the said locating block is rectangular in shape and has a fastener hole through one side and, furthermore, a blind hole in the other side, with a coil spring inserted into the said blind hole; the said standoff block of the said hatch lock button is inserted into the said elongated hole at the center of the said backing plate of the said front cover, a screw is then inserted into the said fastener hole of the said locating block and tightened into the said threaded hole of the said standoff block, enabling the assembly of the said coil spring and the said locating block such that the said hatch lock button is capable of being toggled back and forth on the said backing plate of the said front cover;

the said back cover is a shell plate of one-piece construction having a semicircular opening in the top edge of its anterior section and a slide slot along the inside of the middle section top edge, with a wave-profiled rack arrayed along the bottom edge of the said slide slot; the said rear cover also has an elongated recess along the top edge of its posterior section and, furthermore, an elongated opening is disposed along the bottom portion of the posterior section and a round tape rule enclosure is formed inside the posterior section; additionally, a vertically oriented slide channel is formed inside the anterior section of the said back cover and a threaded hole is tapped at the top edge of the said slide channel; a slide plate extends upward from the said blade ejection button, the said slide plate having an elongated hole through its top edge such that the said elongated hole allows the insertion of a screw which is fastened into the said threaded hole at the said slide channel of the said back cover; the said back cover has a shaft integrated inside the bottom edge of its anterior section and a coil spring is sleeved over the said shaft, with the extended portion of the said coil spring postured horizontally against the bottom edge at the inner side of the said blade ejection button such that the said blade ejection button is constrained within the said slide channel of the back cover, but capable of shifting upward and downward; the said back cover has a threaded mounting hole at the center of its posterior section and, furthermore, a collar hole is disposed through the posterior extremity of the said back cover;

the said hatch is shaped such that it is congruous with the said compartment of the said front cover; the said hatch has a hinge pin formed at each of the upper and lower corners of its anterior side, with the said hatch also having an arcuate catch indentation along the outer edge of the posterior side; additionally, a spring attachment slot is formed at both the anterior and the posterior inner sides of the said hatch; the said flat spring is a one-piece component with a mounting tab at each of its two ends that is punched fabricated from sheet metal; two overlapping tensile elements crisscross inward on the said flat spring; and the said mounting tabs of the said flat spring are inserted into the said spring attachment slots along the inner side of the said hatch;

the said blade holder mechanism consists of a blade carrier, a push button, and a blade arresting component, wherein:

the said push button has a vertical support member at the lower extent of its body; a cylindrical post is formed in the center at one side of the said body and, furthermore, another cylindrical post is formed on the said push button at the lower extent of its anterior edge; and the upper extent of the said push button is surfaced with a pliant lining;

the said blade arresting component has a semicircular pawl at the bottom edge of its anterior extremity, a cylindrical post is disposed at the center of the upper edge of the said blade arresting component and, furthermore, a support pin emerges from one side at the posterior extremity of the said blade arresting component and the said blade arresting component has a rectangular block formed on the lower edge of its anterior section;

the said blade carrier has a T-shaped insertable element formed along the upper edge of its anterior extremity and a skid element along its lower edge; the said blade carrier has a rectangular recess in the center and, furthermore, a semicircular support pin notch is formed in the upper edge at the posterior extremity of the said blade carrier;

the said support pin emerging from one side at the posterior extremity of the said blade holder mechanism blade arresting component is fitted into the said semicircular support pin notch in the upper edge at the posterior extremity of the said blade carrier; a coil spring is sleeved between the said post of the said push button and the other said post disposed at the center of the said blade arresting component; furthermore, the said vertical support member at the lower extent of the said push button is placed through another coil spring and then inserted into the said rectangular recess of the said blade carrier; and the said pawl at the bottom edge along the anterior extremity of the said blade arresting mechanism engages the semicircular notch in the top edge of the said blade, thereby securing the said blade in the said blade holder mechanism;

the said post at one side of the said blade holder mechanism push button of the invention herein is insertionally postured within the said wave-profiled rack beneath the upper edge along the anterior section of the said back cover; the said cushioning button is placed into the said semicircular opening in the top edge along the anterior section of the said front cover; the said upper grip pad is unitarily fabricated out of a soft plastic material and embedded in a long recess molded in the top edge along the posterior section of the said front cover; the said lower grip pad is also unitarily fabricated of a soft plastic material but embedded in a long recess molded in the bottom portion along the posterior section of the said front cover; furthermore, the said two hinge pins of the said hatch are coupled into the said axial holes of the said front cover, enabling the closing of the said hatch over the said compartment of the said front cover, with the said hatch lock button latching the said hatch against the said front cover; and the said front cover and the said rear cover are connected together by inserting a screw through the said fastener hole of the said front cover and then tightening it into the said threaded mounting hole of the said back cover, thereby completing the assembly of the art design knife structure.

* * * * *